US011331916B2

(12) United States Patent
Koike et al.

(10) Patent No.: US 11,331,916 B2
(45) Date of Patent: May 17, 2022

(54) LIQUID EJECTING HEAD AND LIQUID EJECTING APPARATUS

(71) Applicant: Seiko Epson Corporation, Tokyo (JP)

(72) Inventors: Harunobu Koike, Matsumoto (JP); Masao Nakayama, Shiojiri (JP); Toshihiro Shimizu, Fujimi (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/005,490

(22) Filed: Aug. 28, 2020

(65) Prior Publication Data

US 2021/0060948 A1 Mar. 4, 2021

(30) Foreign Application Priority Data

Aug. 30, 2019 (JP) ..... JP2019-157934

(51) Int. Cl.
*B41J 2/14* (2006.01)

(52) U.S. Cl.
CPC ..... *B41J 2/14233* (2013.01); *B41J 2202/10* (2013.01)

(58) Field of Classification Search
None
See application file for complete search history.

(56) References Cited

U.S. PATENT DOCUMENTS

2003/0222943 A1* 12/2003 Sumi ..... H01L 41/1875 347/68
2006/0082617 A1* 4/2006 Nagashima ..... B41J 2/04588 347/68
2008/0239021 A1* 10/2008 Watanabe ..... B41J 2/1632 347/70

FOREIGN PATENT DOCUMENTS

JP 2010-208204 A 9/2010

* cited by examiner

*Primary Examiner* — Erica S Lin
(74) *Attorney, Agent, or Firm* — Harness, Dickey & Pierce, P.L.C.

(57) ABSTRACT

A liquid ejecting head including a flow path forming substrate in which a pressure chamber is formed, a diaphragm, and a piezoelectric actuator. The piezoelectric actuator includes an active portion in which a piezoelectric layer is interposed between a first electrode and a second electrode. The active portion, in plan view, overlaps at least a portion of the pressure chamber and is provided so as to extend to an outside of the pressure chamber. The pressure chamber is formed so that, the closer to the piezoelectric actuator in a layered direction of the flow path forming substrate and the diaphragm, a width of the pressure chamber in a direction intersecting the layered direction becomes smaller.

12 Claims, 10 Drawing Sheets

LIQUID EJECTING HEAD AND LIQUID EJECTING APPARATUS

The present application is based on, and claims priority from JP Application Serial Number 2019-157934, filed Aug. 30, 2019, the disclosure of which is hereby incorporated by reference herein in its entirety.

BACKGROUND

1. Technical Field

The present disclosure relates to a liquid ejecting head that ejects a liquid through nozzles and to a liquid ejecting apparatus and, in particular, relates to an ink jet recording head that ejects ink serving as the liquid and to an ink jet recording system.

2. Related Art

In a known ink jet recording head that ejects ink, a diaphragm is provided on a flow path forming substrate in which a pressure chamber is formed, and a piezoelectric actuator is provided on the diaphragm. The known piezoelectric actuator is formed by layering, from the diaphragm side, a first electrode, a piezoelectric layer, and a second electrode.

In one known form of the piezoelectric actuator, an active portion of the piezoelectric actuator is provided in an area (hereinafter, a moveable area) of the diaphragm that opposes a pressure chamber, and the active portion is provided so as to extend to the outside of the moveable area, or to the outside of the pressure chamber (see JP-A-2010-208204, for example).

However, in the piezoelectric actuator configured in the above-described manner, since the active portion is provided to the outside of the pressure chamber, the amount of displacement of the diaphragm can be increased; however, cracking may occur at an end portion of the diaphragm.

Note that such issues exist not only in ink jet recording heads but also, in a similar manner, in liquid ejecting heads that eject a liquid other than ink.

In view of the above circumstances, an object of the present disclosure is to provide a liquid ejecting head and a liquid ejecting apparatus with improved reliability by suppressing cracking in the diaphragm from occurring.

SUMMARY

An aspect of the present disclosure that overcomes the above issue is a liquid ejecting head including a flow path forming substrate in which a pressure chamber in communication with a nozzle is formed, a diaphragm formed on one side of the flow path forming substrate, and a piezoelectric actuator including a first electrode, a piezoelectric layer, and a second electrode that are formed on the diaphragm on a side opposite the flow path forming substrate. In the liquid ejecting head, the piezoelectric actuator includes an active portion in which the piezoelectric layer is interposed between the first electrode and the second electrode, the active portion, in plan view, overlaps at least a portion of the pressure chamber and is extended to an outside of the pressure chamber, and the pressure chamber is formed so that, the closer to the piezoelectric actuator in a layered direction of the flow path forming substrate and the diaphragm, a width of the pressure chamber in a direction intersecting the layered direction becomes smaller.

Furthermore, another aspect is a liquid ejecting apparatus including the liquid ejecting head described above.

DESCRIPTION OF EXEMPLARY EMBODIMENTS

Figure 1:
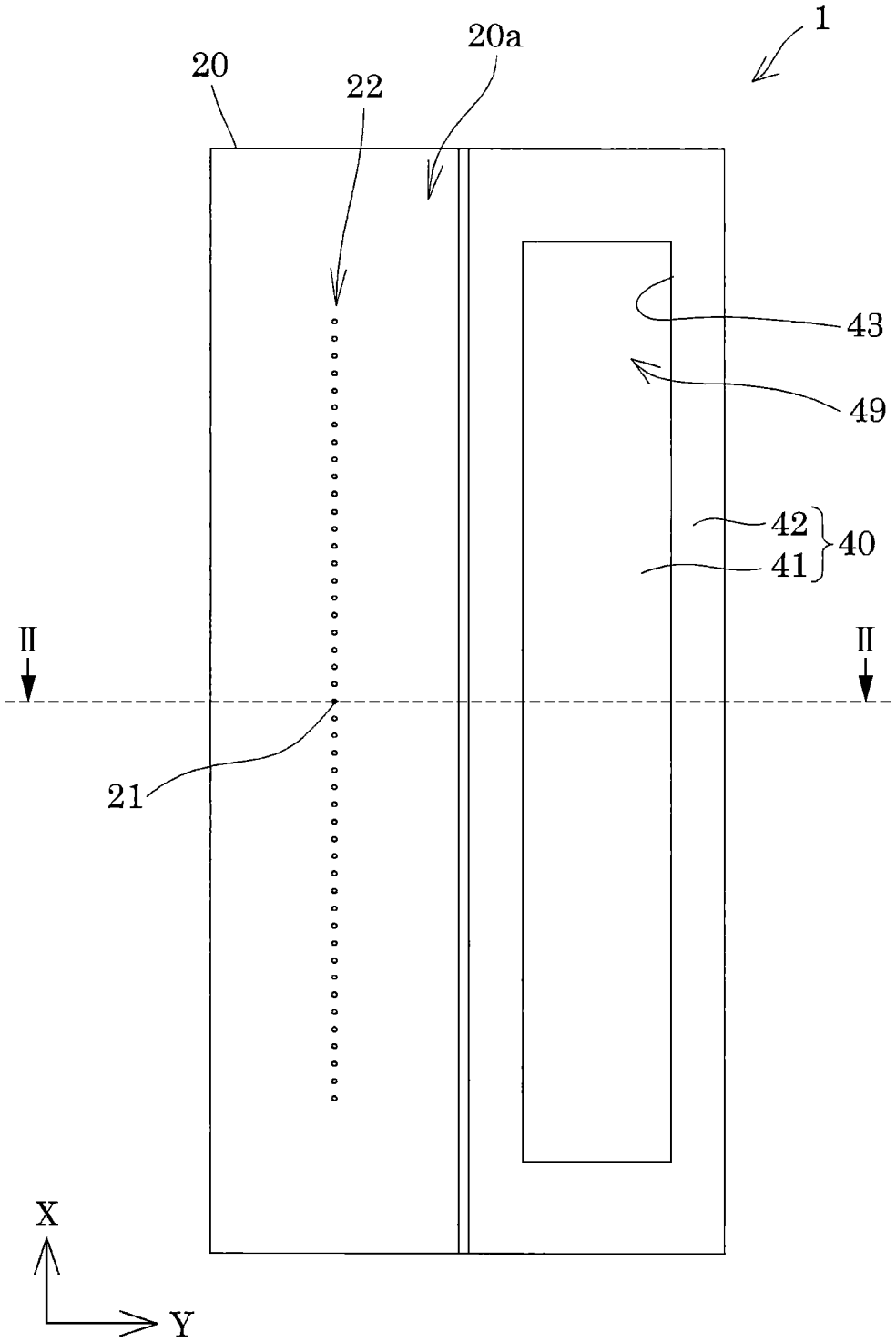
FIG. 1 is a plan view of a recording head according to a first exemplary embodiment.

The present disclosure will be described in detail with reference to the exemplary embodiments. However, the description hereinafter illustrates an aspect of the present disclosure and can be modified in any manner within the scope of the present disclosure. Members attached with the same reference numerals in the drawings depict the same member and description thereof is appropriately omitted. Furthermore, X, Y, and Z in the drawings indicate three spatial axes that are orthogonal to each other. In the present specification, directions extending along the above axes are referred to as an X direction, a Y direction, and a Z direction. The description will be given while a positive (+) direction is a direction in which each of the arrows in the drawings is oriented and a negative (−) direction is a direction opposite the direction in which each of the arrows is oriented. Furthermore, the Z direction indicates a vertical direction, a +Z direction indicates vertically downwards, and a −Z direction indicates vertically upwards.

First Exemplary Embodiment

Figure 2:
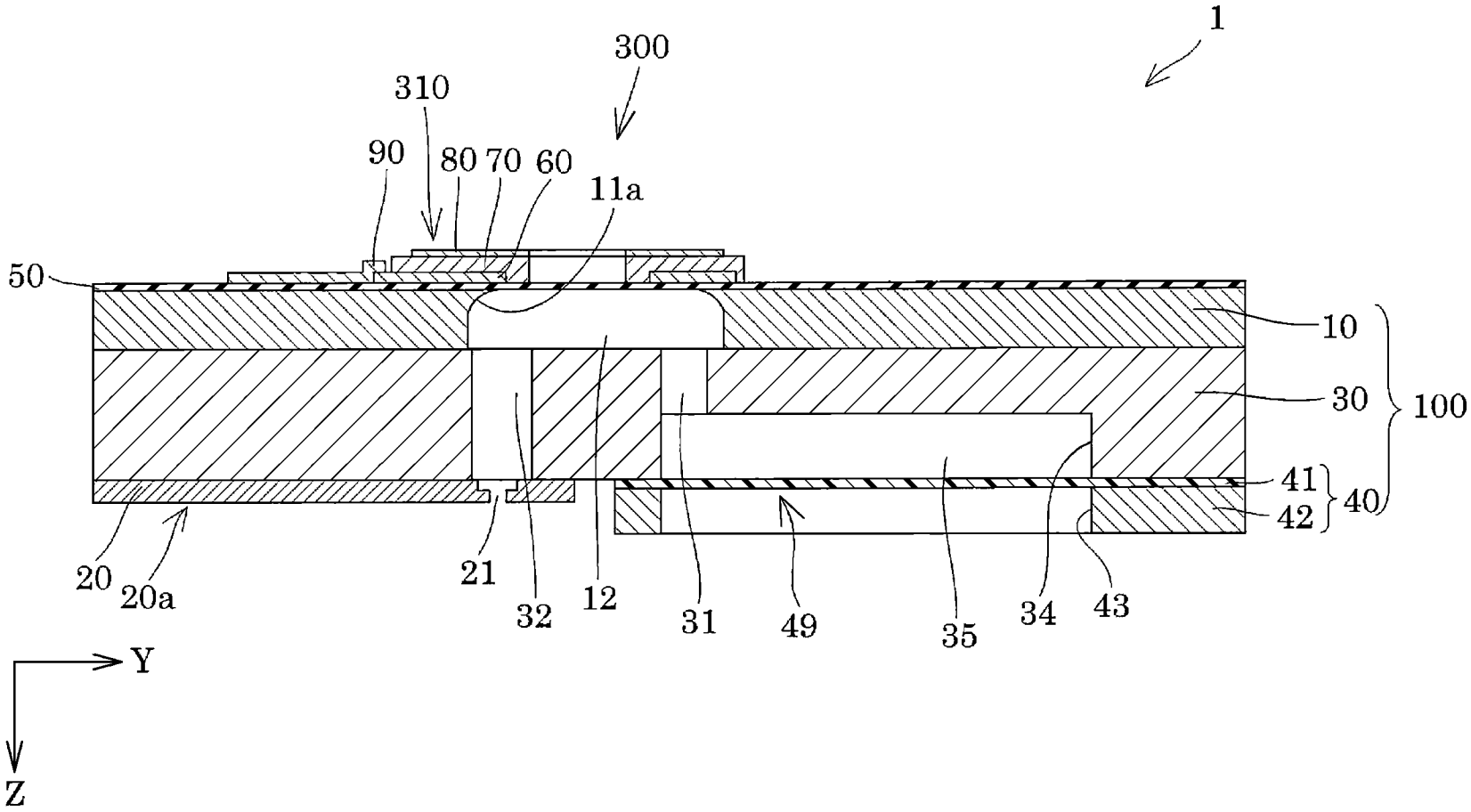
FIG. 2 is a cross-sectional view of the recording head according to the first exemplary embodiment.
Figure 3:
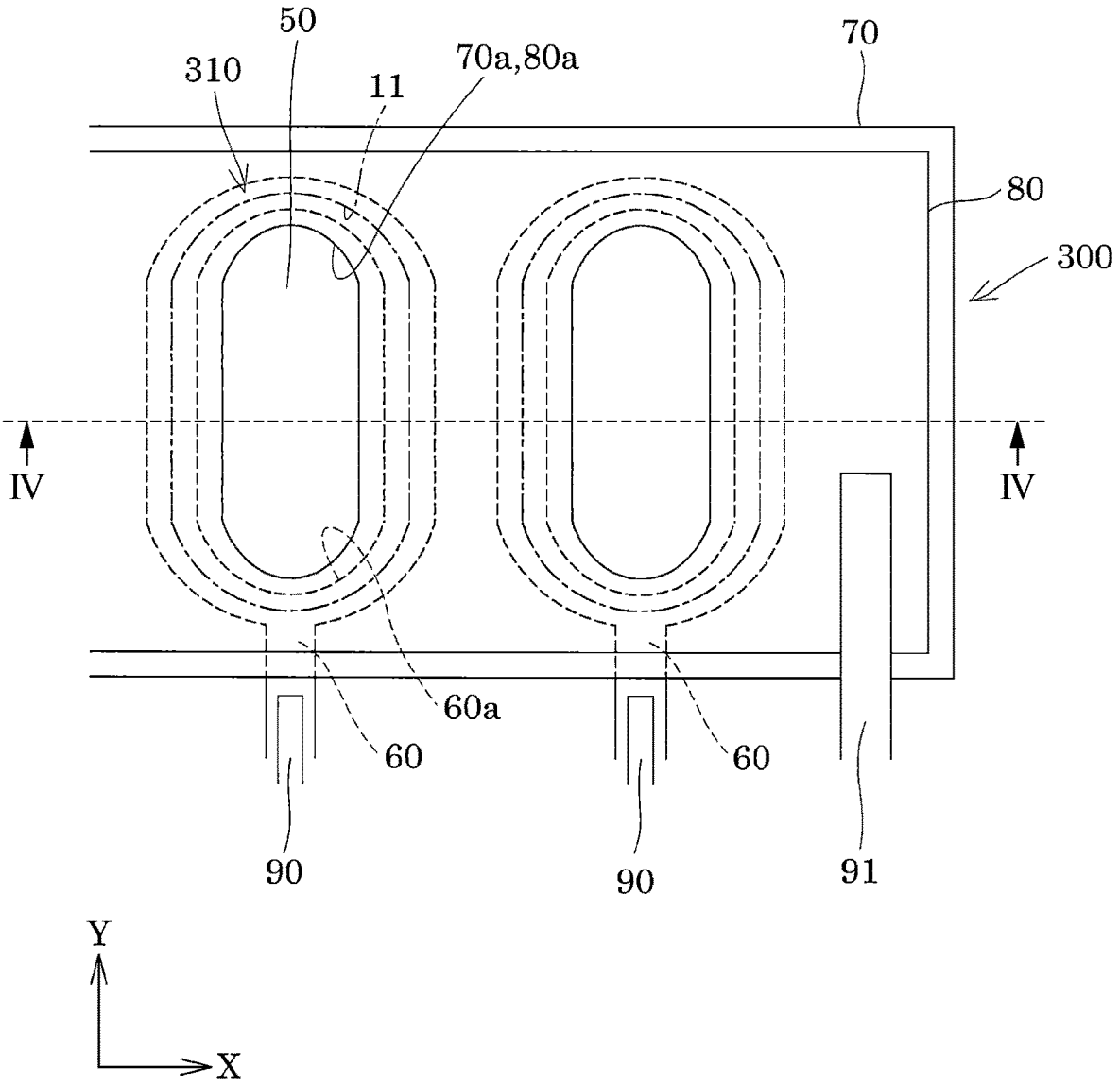
FIG. 3 is a plan view of an essential portion of piezoelectric actuators according to the first exemplary embodiment.
Figure 4:
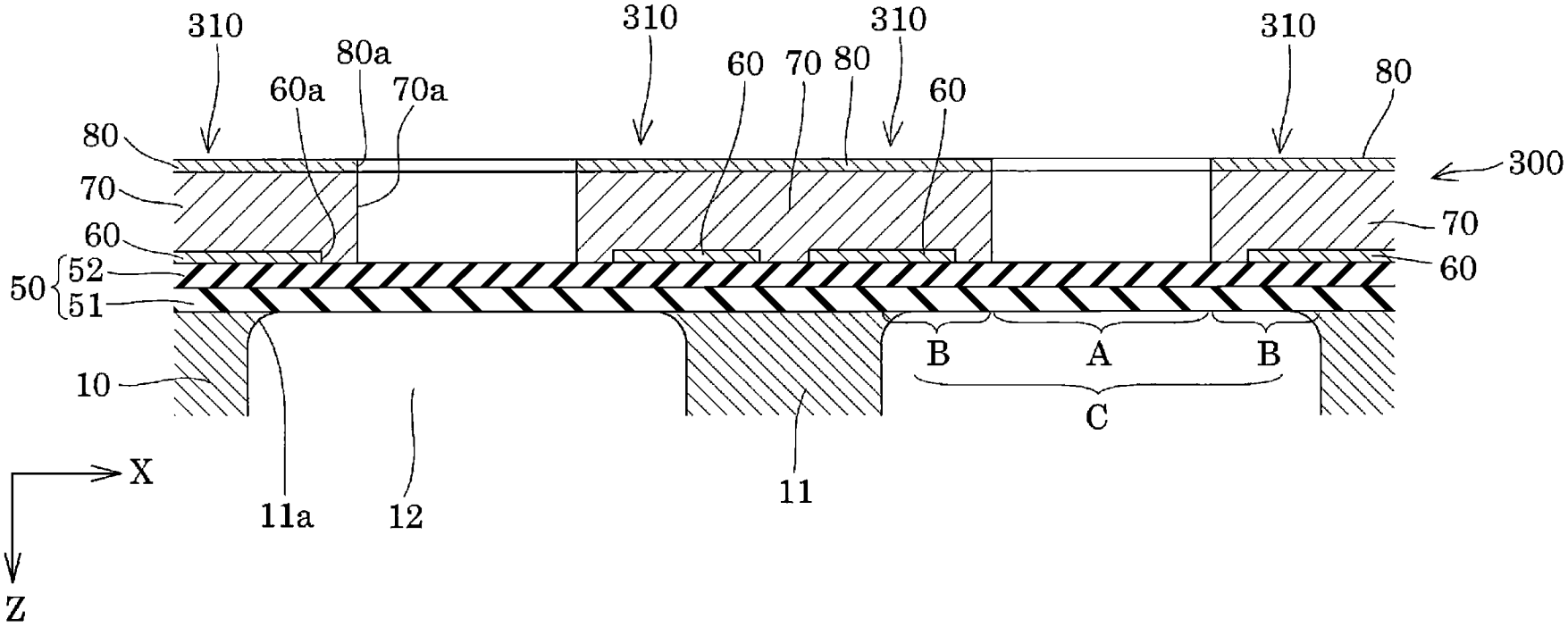
FIG. 4 is a cross-sectional view of an essential portion of the piezoelectric actuators according to the first exemplary embodiment.

Referring to FIGS. 1 to 4, a description of an ink jet recording head (hereinafter, referred to as a recording head), which is an example of a liquid ejecting head, will be given. FIG. 1 is a plan view of the recording head viewed from a nozzle surface side. FIG. 2 is a cross-sectional view taken along line II-II in FIG. 1. FIG. 3 is a plan view of essential portions of piezoelectric actuators provided in the recording head illustrated in an enlarged manner. FIG. 4 is a cross-sectional view taken along line IV-IV in FIG. 3.

The recording head 1 includes a flow path unit 100, a diaphragm 50, and piezoelectric actuators 300. The flow path unit 100 of the present exemplary embodiment is configured so that a flow path forming substrate 10, a common liquid chamber substrate 30, a nozzle plate, 20 and a compliance substrate 40 are joined to each other.

The diaphragm 50 is formed on a −Z side of the flow path forming substrate 10. The diaphragm 50 of the present exemplary embodiment includes an elastic film 51 and an insulating film 52. The elastic film 51 is a film containing silicon oxide and is formed on one side of the flow path forming substrate 10 in the −Z direction. Furthermore, the insulating film 52 is a film containing zirconium oxide and is formed on the one side of the elastic film 51 in the −Z direction.

In the diaphragm 50 configured in the above manner, areas that oppose pressure chambers 12 are referred to as moveable areas C. Furthermore, in each moveable area C in plan view, an area that is inside an end portion (a partition wall 11) of the corresponding pressure chamber 12 and that does not include the center of the pressure chamber 12 is referred to as an edge portion B. Furthermore, in the moveable area C, an area other than the edge portion B is referred to as a center portion A.

The flow path forming substrate 10 is a silicon single crystal substrate and is a substrate in which the pressure chambers 12 are formed. Specifically, a plurality of pressure chambers 12 partitioned by a plurality of partition walls 11 are formed in the flow path forming substrate 10.

The plurality of pressure chambers 12 are arranged side by side at a predetermined pitch in the X direction, which is a direction in which a plurality of nozzles 21 that discharge ink are arranged side by side. A single row of pressure chambers 12 arranged side by side in the X direction is provided in the present exemplary embodiment. Furthermore, the flow path forming substrate 10 is disposed so that in-plane directions thereof include the X direction and the Y direction. It goes without saying that the arrangement of the pressure chambers 12 is not limited to the above and, for example, may be a so-called staggered arrangement in which, in the pressure chambers 12 arranged side by side in the X direction, every other pressure chamber 12 is disposed at a position shifted in the Y direction. Furthermore, the arrangement of the nozzles 21 may be a so-called matrix arrangement in which a plurality of nozzles 21 are arranged at predetermined intervals in the X direction and the Y direction.

The shape of the pressure chamber 12 of the present exemplary embodiment in plan view (see FIG. 3) is a substantially elliptical shape, in which the Y direction is the major axis. As illustrated in FIG. 2, a first flow path 31 and a second flow path 32 are coupled to two ends of the pressure chamber 12 in the longitudinal direction thereof. Note that the shape of the pressure chamber 12 is not limited in particular to the above shape and, for example, may have a square shape, a rectangular shape, a polygonal shape, a parallelogram shape, a circular shape, or a long hole shape. Incidentally, a long hole shape is an oval shape or a shape that resembles an oval shape such as, for example, a rectangular shape with round corners, an egg shape, and an elliptical shape.

Referring now to FIG. 4, a configuration of the pressure chamber 12 will be described in detail. A piezoelectric actuator 300 side of each pressure chamber 12 is defined by the partition wall 11 formed in the flow path forming substrate 10 and by the diaphragm 50. Such a pressure chamber 12 is defined by performing anisotropic etching on the flow path forming substrate 10 from a side on which the nozzle plate 20 is joined and by providing the diaphragm 50 on a surface of the pressure chamber 12 on a side opposite the nozzle plate 20.

The pressure chamber 12 is formed so that, the closer to the piezoelectric actuator 300, the widths of the pressure chamber 12 become smaller. Note that the widths of the pressure chamber 12 herein are widths in directions that intersect the Z direction, which is a direction in which the flow path forming substrate 10 and the diaphragm 50 are layered. In other words, the widths of the pressure chamber 12 are a width in the X direction and a width in the Y direction.

Specifically, a curved surface 11*a* is formed in the boundary between the partition wall 11 and the diaphragm 50 that define the pressure chamber 12. The boundary between the partition wall 11 and the diaphragm 50 is a portion where a surface of the partition wall 11 and a surface of the diaphragm 50 intersect each other. The curved surface 11*a* being formed in such a boundary denotes that a curved surface is formed in the vicinity of the boundary in at least one of the partition wall 11 and the diaphragm 50. In the example illustrated in FIG. 4, the diaphragm 50 is formed in a substantially flat manner, and the curved surface 11*a* is formed in the partition wall 11 at a vicinity of the boundary with the diaphragm 50. By forming the curved surface 11*a* in the pressure chamber 12 in the boundary between the diaphragm 50 and the partition wall 11, the pressure chamber is formed so that, the closer to the piezoelectric actuator 300 in a layered direction, the widths of the pressure chamber become smaller.

Furthermore, a radius of curvature of the curved surface 11*a* ranges preferably from 10 nm to 1000 nm inclusive. Note that while a cross section of the curved surface 11*a* has a circular-arc shape, not limited to a circular-arc shape, the cross section may have an oval shape.

The common liquid chamber substrate 30 is a substrate in which a common liquid chamber 35 in communication with the pressure chambers 12 is formed, and is provided on the +Z side of the flow path forming substrate 10. The common liquid chamber substrate 30 can be fabricated of, for example, metal such as stainless steel, glass, or a ceramic material. Desirably, a material that has a coefficient of thermal expansion that is substantially the same as that of the flow path forming substrate 10 is used for the common liquid chamber substrate 30. In the present exemplary embodiment, the common liquid chamber substrate 30 is formed using a silicon single crystal substrate that is a material that is the same as that of the flow path forming substrate 10.

A recessed portion 34 open towards the +Z side is formed in the common liquid chamber substrate 30. On a surface of the common liquid chamber substrate 30 on the +Z side, the compliance substrate 40 including a compliance portion 49 seals the opening of the recessed portion 34 on the +Z side. In the common liquid chamber substrate 30, the common liquid chamber 35 is formed by the compliance substrate 40 sealing the recessed portion 34.

In the present exemplary embodiment, such a compliance substrate 40 includes a sealing film 41 formed of a thin flexible film, and a fixture substrate 42 formed of a hard material such as metal. Since the area in the fixture substrate 42 opposing the common liquid chamber 35 is an opening portion 43, which is completely removed in the thickness direction, a portion of the wall surfaces of the common liquid chamber 35 is the compliance portion 49, which is a flexible portion sealed with the flexible sealing film 41 alone. By providing the compliance portion 49 in a portion of the wall surfaces of the common liquid chamber 35 in the above manner, the pressure change in the ink inside the common liquid chamber 35 can be absorbed by deformation of the compliance portion 49.

Furthermore, a plurality of first flow paths 31 each in communication with a corresponding pressure chamber 12 are formed in the common liquid chamber substrate 30. The first flow paths 31 are flow paths that couple the pressure chambers 12 and the common liquid chamber 35 to each other and are provided so as to penetrate the common liquid chamber substrate 30 in the Z direction. The first flow path 31 is in communication with the common liquid chamber 35 at the end portion in the +Z direction, and is in communication with the pressure chamber 12 at the end portion in the −Z direction.

Furthermore, a plurality of second flow paths 32 each in communication with a corresponding pressure chamber 12 and a corresponding nozzle 21 are formed in the common liquid chamber substrate 30. The second flow paths 32 are flow paths that couple the pressure chambers 12 and the nozzles 21 to each other and are provided so as to penetrate the common liquid chamber substrate 30 in the Z direction. The second flow path 32 is in communication with the nozzle 21 at the end portion in the +Z direction, and is in communication with the pressure chamber 12 at the end portion in the −Z direction.

The nozzle plate 20 is provided on the +Z side of the common liquid chamber substrate 30. A plurality of nozzles 21 that eject ink in the +Z direction is formed in the nozzle plate 20. As illustrated in FIG. 1, in the present exemplary embodiment, a single nozzle row 22 is formed by disposing the plurality of nozzles 21 along a straight line extending in the X direction. The nozzle plate 20 can be, for example, formed of a flat plate material made of metal such as stainless steel (SUS), an organic matter such as a polyimide resin, a silicon, or the like. It goes without saying that the arrangement of the nozzles 21 is not limited to the above and, for example, may be a so-called staggered arrangement in which, in the nozzles 21 arranged side by side in the X direction, every other nozzle 21 is disposed at a position shifted in the Y direction. Furthermore, the arrangement of the nozzles 21 may be a so-called matrix arrangement in which a plurality of nozzles 21 are arranged at predetermined intervals in the X direction and the Y direction.

Ink flow paths from the common liquid chamber 35 reaching the nozzles 21 through the first flow paths 31, the pressure chambers 12, and the second flow paths 32 are formed in the flow path unit 100 configured in the above manner. Note that while not particularly illustrated in the drawings, the common liquid chamber 35 is configured so that ink is supplied from an external ink supply member. The ink supplied from the external ink supply member is supplied to the common liquid chamber 35. Subsequently, the ink is supplied from the common liquid chamber 35 to each pressure chamber 12 through the corresponding first flow path 31. The ink in the pressure chambers 12 is, owing to the piezoelectric actuators 300 described later, ejected through the nozzles 21 via the second flow paths 32.

The piezoelectric actuators 300 each constituted by the first electrode 60, the piezoelectric layer 70, and the second electrode 80 layered by film forming and with a lithography method are situated on a surface of the diaphragm 50, which is formed on the flow path forming substrate 10, opposite the flow path forming substrate 10.

Either one of the electrodes of the piezoelectric actuator 300 is configured to serve as a common electrode. The other electrode and the piezoelectric layer 70 are formed in the corresponding pressure chamber 12 by patterning. In the present exemplary embodiment, the first electrode 60 is configured to serve as an individual electrode of the piezoelectric actuator 300, and the second electrode 80 is configured to serve as the common electrode of the piezoelectric actuator 300.

In the piezoelectric actuator 300, a portion where the piezoelectric layer 70 is interposed between the first electrode 60 and the second electrode 80 is referred to as an active portion 310. The active portion 310 is provided for each pressure chamber 12.

In plan view as illustrated in FIG. 3, the active portion 310 overlaps at least a portion of the pressure chamber 12 and is extended to the outside of the pressure chamber 12. In the present exemplary embodiment, the active portion 310 is provided in the edge portion B of the moveable area C (see FIG. 4) of the diaphragm 50. The active portion 310 is not provided in the center portion A. In other words, the active portion 310 provided in the edge portion B corresponds to a portion that overlaps at least a portion of the pressure chamber 12. Furthermore, in the present exemplary embodiment, the active portion 310 is provided outside the edge portion B, that is, the active portion 310 is provided so as to extend to the outside of the pressure chamber 12. As illustrated in FIG. 3, the shape of such an active portion 310 in plan view is, substantially similar to that of the pressure chamber 12, substantially an elliptical shape in which the longitudinal direction is the Y direction.

Each first electrode 60 is formed in an annular shape in plan view. In other words, similar to the pressure chamber 12, the first electrode 60 has a substantially elliptical outer circumferential shape in which the Y direction is the major axis, and an opening portion **60*a* having a shape substantially analogous to the outer circumferential shape at the center portion. Furthermore, the first electrode 60 is formed so as to overlap the partition wall 11. In other words, the opening portion 60*a* of the first electrode 60 is positioned inside the partition wall 11, and the outer circumference of the first electrode 60 is positioned outside the partition wall 11 (on the side opposite the pressure chamber 12). Note that the first electrode 60** is configured of a conductive material such as, for example, gold, silver, copper, palladium, platinum, or titanium.

The piezoelectric layer 70 is commonly formed for each active portion 310 so as to cover each first electrode 60. Furthermore, first through holes **70*a* penetrating in the thickness direction are formed in the piezoelectric layer 70. In plan view (see FIG. 3), the first through hole 70*a* is positioned inside the opening portion 60*a* of the first electrode 60, and includes an opening that has a shape that is substantially analogous to the opening portion 60*a***.

Such a piezoelectric layer 70 can be constituted by a ferroelectric piezoelectric material, such as a ceramics-based material including, for example, lead zirconate titanate (PZT) or the like. The piezoelectric layer 70 described above can be obtained by applying a piezoelectric material to cover the first electrodes 60 and by forming the first through holes **70*a* by etching. It goes without saying that the piezoelectric layer 70 does not have to be commonly provided for each first electrode 60 and can be formed for each first electrode 60**.

The second electrode 80 is formed, commonly for the active portions 310, on the piezoelectric layer 70. Furthermore, second through holes **80*a* penetrating in the thickness direction are formed in the second electrode 80. The second through hole 80*a* has a shape that is substantially the same as that of the first through hole 70*a* and is disposed so as to overlap the first through hole 70***a*. Note that the second electrode 80 is configured of a conductive material such as, for example, gold, silver, copper, palladium, platinum, or titanium.

In the Y direction, each first electrode 60 is drawn to the outside of the piezoelectric layer 70. A first lead electrode 90 is coupled to each first electrode 60. A second lead electrode 91 is coupled to the second electrode 80. In the Y direction, the second lead electrode 91 is drawn out in a direction that is the same as that of the first lead electrodes 90.

Each first lead electrode 90 is coupled to the first electrode 60 of the corresponding piezoelectric actuator 300. A voltage is selectively applied to the piezoelectric actuators 300 through the first lead electrodes 90. Furthermore, the second lead electrode 91 is coupled to the second electrode 80 common to each of the piezoelectric actuators 300. A bias voltage is applied to the second electrode 80 through the second lead electrode 91.

In such a recording head 1, when a voltage is applied to the first electrodes 60 of the piezoelectric actuators 300 and to the second electrode 80, the active portions 310 become flexed and deformed. The diaphragm 50 becomes deformed due to flexing and deformation of the active portions 310, which applies pressure to the ink inside the pressure chambers 12 and ejects the ink through the nozzles 21. Note that the active portion 310 is provided in the edge portion B of the diaphragm 50 and the active portion 310 is not provided in the center portion A. In such a piezoelectric actuator 300 configured in the above manner, compared with a configuration in which the active portion 310 is provided in the center portion A, the amount of displacement of the diaphragm 50 is improved and the amount of ejected ink is increased.

Note that in the example described above, while the diaphragm 50 and the first electrode 60 act as a diaphragm, it goes without saying that not limited to the above, for example, the diaphragm 50 may not be provided and the first electrode 60 alone may act as a diaphragm. Furthermore, the piezoelectric actuator 300 itself may substantially serve as the diaphragm as well.

As described above, in the recording head 1 of the present exemplary embodiment, the active portion 310 of the piezoelectric actuator 300 in plan view overlaps at least a portion of pressure chamber 12 and is extended to the outside of the pressure chamber 12. In other words, the active portion 310 is provided in the edge portion B of the moveable area C (see FIG. 4) of the diaphragm 50, and the active portion 310 is not provided in the center portion A and is not provided outside of the edge portion B. By providing such an active portion 310, the amount of displacement of the diaphragm 50 can be increased, and the amount of ink ejected can be increased.

Furthermore, the closer to the piezoelectric actuator 300 in the Z direction, the widths of each pressure chamber 12 of the recording head 1 of the present exemplary embodiment in the X direction and the Y direction, which intersect the Z direction, become smaller. Owing to the above, the pressure chamber 12 is structured so that concentration of stress acting on the boundary between the diaphragm 50 and the partition wall 11 does not occur easily; accordingly, occurrence of cracking in the diaphragm 50 at the vicinity of the boundary is suppressed and the reliability of the recording head 1 can be increased.

As described above, the recording head 1 of the present exemplary embodiment can achieve both an increase in the amount of displacement of the diaphragm 50 and suppression of the occurrence of cracking in the diaphragm 50.

Furthermore, in the present exemplary embodiment, the curved surface 11*a* is formed in the boundary between the diaphragm 50 and the partition wall 11. When the piezoelectric actuator 300 is driven, the diaphragm 50 vibrates and stress is generated in the diaphragm 50. The above stress spreads and is distributed throughout the curved surface 11*a* such that the stress does not easily become concentrated in the end portion of the diaphragm 50 (the vicinity of the boundary between the diaphragm 50 and the partition wall 11). Accordingly, occurrence of cracking in the diaphragm 50 can be suppressed and the reliability of the recording head 1 can be increased.

Furthermore, by having the radius of curvature of the curved surface 11*a* be in the range from 10 nm to 1000 nm inclusive, the concentration of stress can be relieved further and occurrence of cracking in the diaphragm 50 can be suppressed in a more reliable manner.

Second Exemplary Embodiment

Figure 5:
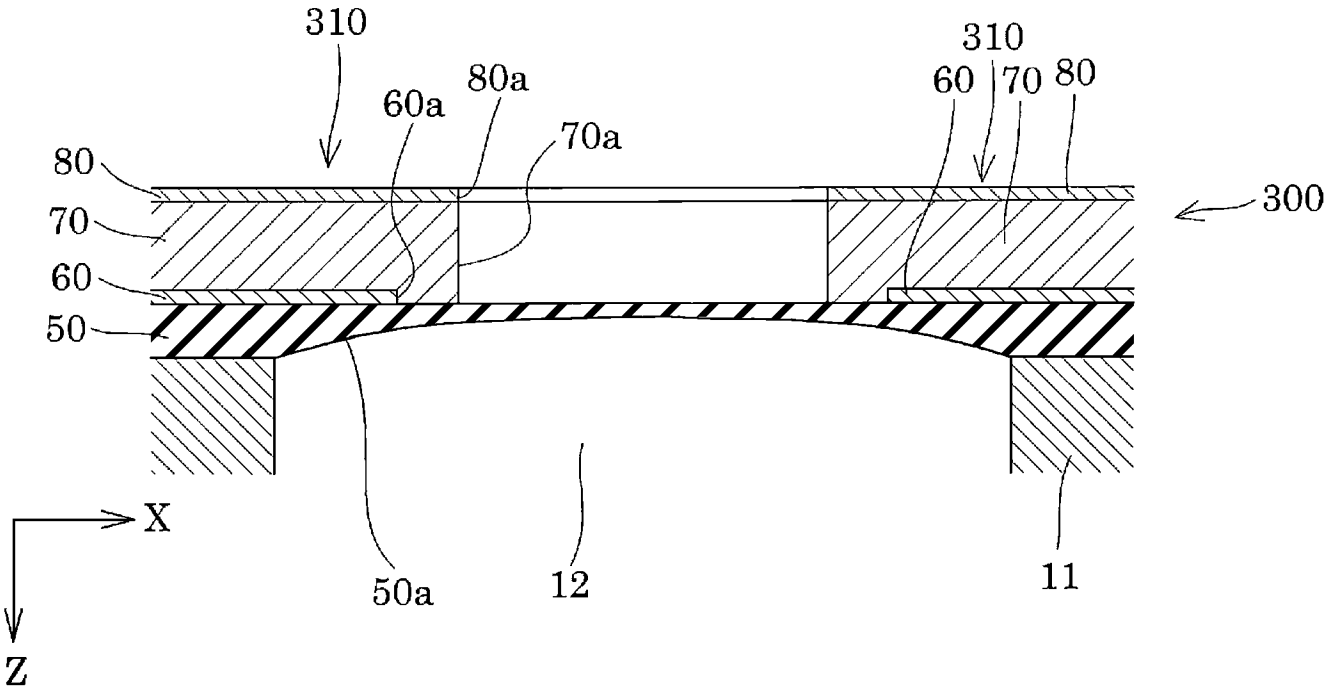
FIG. 5 is a cross-sectional view of an essential portion of piezoelectric actuators according to a second exemplary embodiment.
Figure 6:
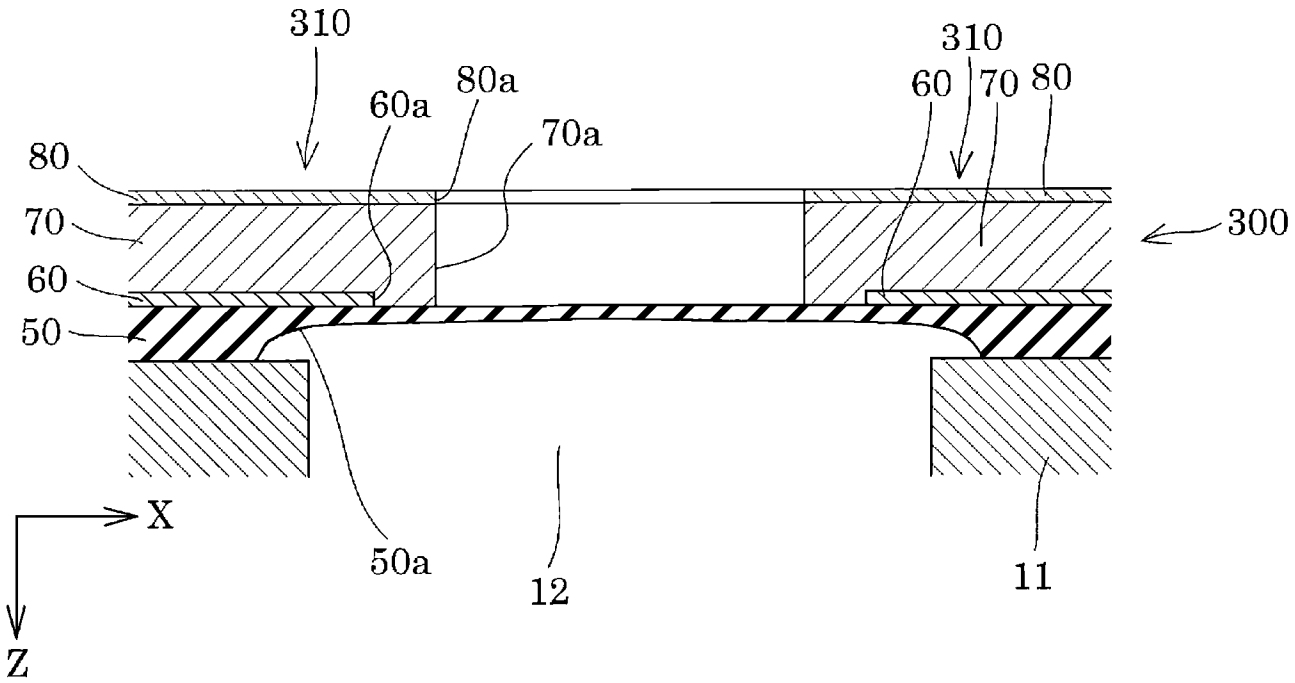
FIG. 6 is a cross-sectional view of an essential portion of the piezoelectric actuators according to the second exemplary embodiment.
Figure 7:
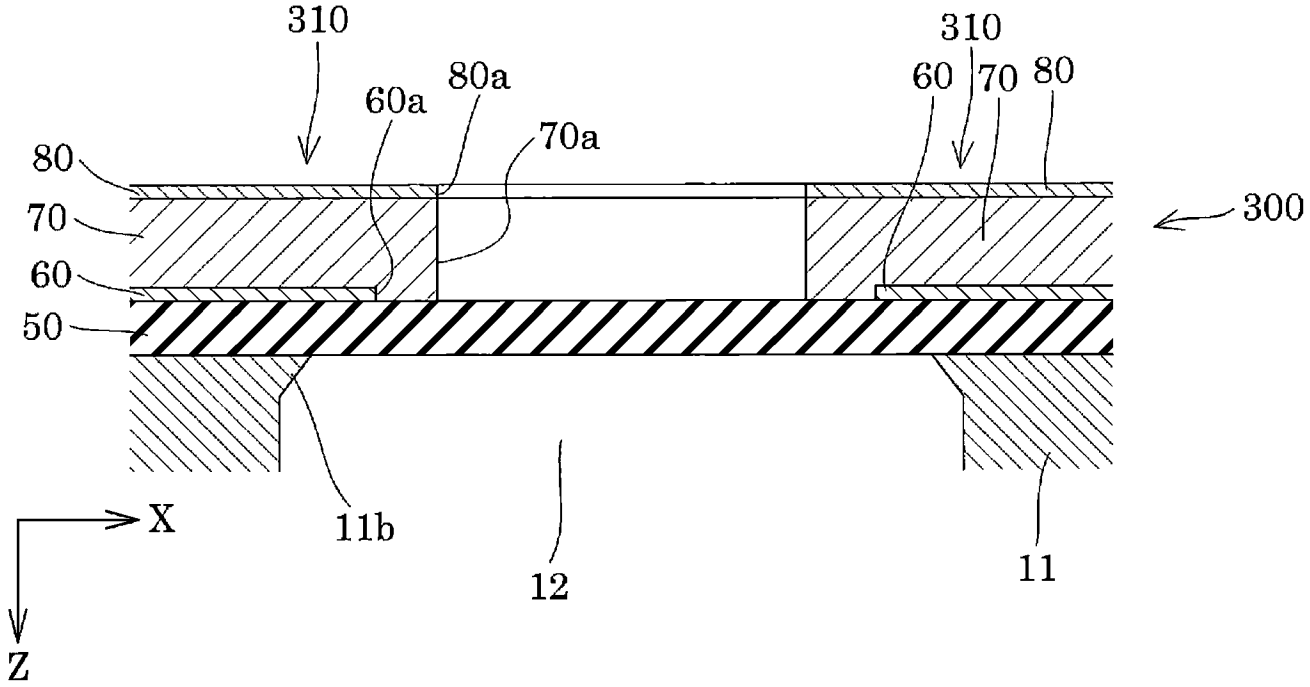
FIG. 7 is a cross-sectional view of an essential portion of the piezoelectric actuators according to the second exemplary embodiment.

Referring to FIGS. 5 to 7, a recording head according to a second exemplary embodiment will be described. FIGS. 5 to 7 are cross-sectional views of the recording head cut along a plane that is parallel to an XZ plane that passes through the piezoelectric actuator 300 and the pressure chamber 12. Note that components that are the same as those of the first exemplary embodiment are denoted with the same reference numerals and repeated descriptions thereof are omitted.

As illustrated in FIG. 5, a curved surface 50*a* is formed in the boundary between the partition wall 11 and the diaphragm 50 that define the pressure chamber 12. An inner surface of the partition wall 11 that faces the pressure chamber 12 is formed in a substantially flat manner, and a recessed curved surface 50*a* is formed on the pressure chamber 12 side of the diaphragm 50. By forming the curved surface 50*a* in the pressure chamber 12 in the boundary between the diaphragm 50 and the partition wall 11, the pressure chamber 12 is formed so that, the closer to the piezoelectric actuator 300 in the layered direction, the widths of the pressure chamber 12 become smaller.

When the piezoelectric actuator 300 is driven, the diaphragm 50 vibrates and stress is generated in the diaphragm 50. The above stress spreads and is distributed throughout the curved surface 50*a* and does not easily become concentrated. Accordingly, occurrence of cracking in the diaphragm 50 can be suppressed and the reliability of the recording head 1 can be increased.

As illustrated in FIG. 6, the curved surface 50*a* formed in the diaphragm 50 is provided so as to be positioned on an upper side, or on the piezoelectric actuator 300 side, of the partition wall 11 in the Z direction, which is a direction in which the flow path forming substrate 10 and the diaphragm 50 are layered. The curved surface 50*a* being positioned on the upper side of the partition wall 11 denotes that at least a portion of the curved surface 50*a* of the diaphragm 50 is positioned on the upper side of the partition wall 11. In other words, the curved surface 50*a* of the diaphragm 50 is formed in the boundary between the diaphragm 50 and the partition wall 11, and the inner surface of the partition wall 11 is positioned on the pressure chamber 12 side with respect to the boundary.

In the recording head 1 configured in the above manner as well, as described above, the recording head 1 is structured so that, owing to the curved surface 50*a*, the stress generated in the diaphragm 50 does not easily become concentrated. Accordingly, occurrence of cracking in the diaphragm 50 can be suppressed and the reliability of the recording head 1 can be increased. Furthermore, since the curved surface 50*a* is provided on the upper side of the partition wall 11, the volumetric capacity of the pressure chamber 12 can be increased and a larger amount of ink can be ejected.

As illustrated in FIG. 7, an end portion of the partition wall 11 on the piezoelectric actuator 300 side is formed in a tapered manner. The end portion is referred to as a tapered portion 11*b*. In other words, the tapered portion 11*b* is inclined towards the inner side of the pressure chamber 12 as the tapered portion 11*b* extends towards the piezoelectric actuator 300 in the Z direction, which is the layered direction. By providing such a tapered portion 11*b*, the closer to the piezoelectric actuator 300 in the Z direction, the widths of the pressure chamber 12 in the X direction and the Y direction become smaller.

In the recording head 1 configured in the above manner, the stress generated in the diaphragm 50 with the drive of the piezoelectric actuator 300 spreads and is distributed throughout the tapered portion 11*b* and does not easily become concentrated. Accordingly, occurrence of cracking in the diaphragm 50 can be suppressed and the reliability of the recording head 1 can be increased.

Furthermore, while not illustrated in the drawing in particular, a stair-like step portion that protrudes towards the inner side of the pressure chamber 12 may be formed in the end portion of the partition wall 11 on the piezoelectric actuator side. The stress generated in the diaphragm 50 with the piezoelectric actuator 300 can be made to spread and be distributed in such a step portion and can be made not to become concentrated.

Third Exemplary Embodiment

Figure 8:
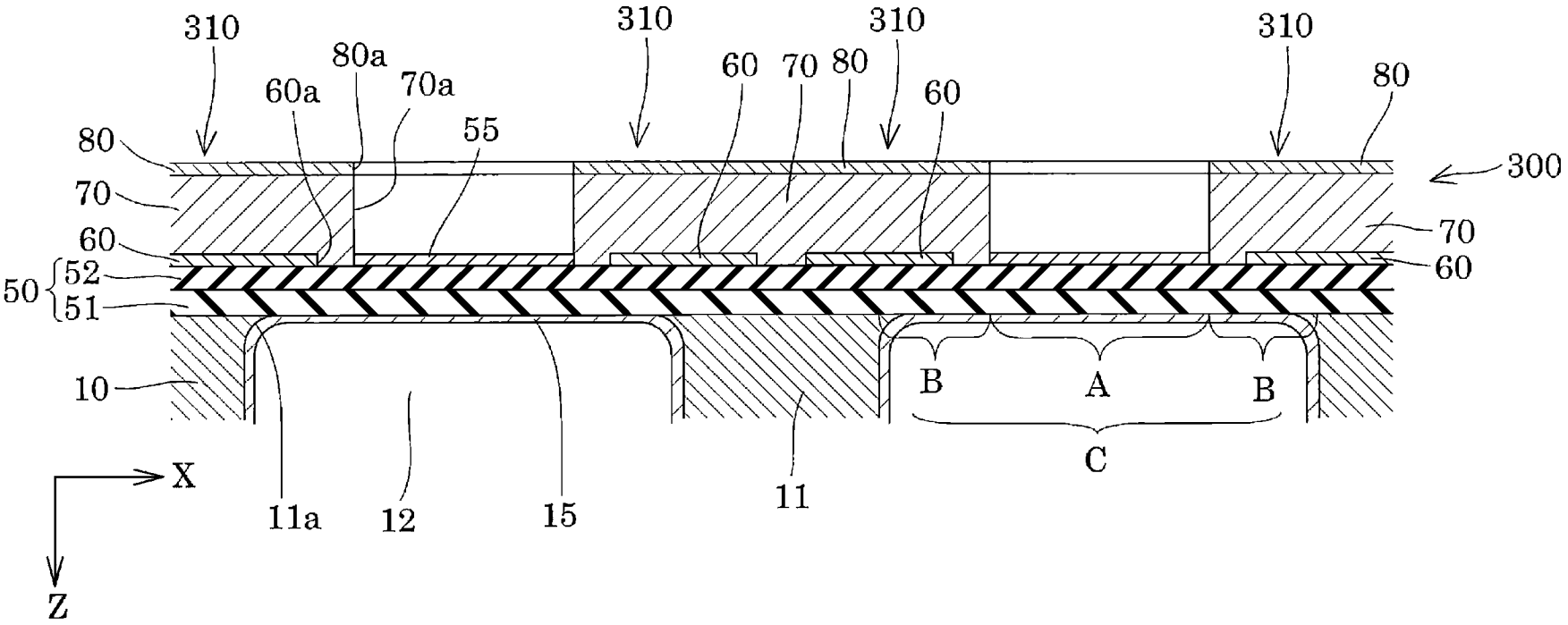
FIG. 8 is a cross-sectional view of an essential portion of piezoelectric actuators according to a third exemplary embodiment.

Referring to FIG. 8, a recording head according to a third exemplary embodiment will be described. FIG. 8 is a cross-sectional view of the recording head cut along a plane that is parallel to the XZ plane that passes through the piezoelectric actuator 300 and the pressure chamber 12. Note that components that are the same as those of the first exemplary embodiment are denoted with the same reference numerals and repeated descriptions thereof are omitted.

In the recording head 1 of the present exemplary embodiment, a first amorphous film 15 is formed on the inner surfaces of the pressure chamber 12 and on a surface of the diaphragm 50 on the pressure chamber 12 side. The active portion 310 of the piezoelectric actuator 300 is, in the moveable area C, not only formed in the edge portion B but is also formed above the partition wall 11. Accordingly, compared with a configuration in which the active portion 310 is not formed above the partition wall 11, force that deforms the diaphragm 50 in a greater manner acts on the diaphragm 50. Due to the above, although there will be a larger stress on the diaphragm 50, the first amorphous film 15 can increase the stiffness of the diaphragm 50, and occurrence of cracking in the diaphragm 50 can be suppressed.

Furthermore, the first amorphous film 15 is also formed on the inner surfaces of the pressure chamber 12. With the above, the partition wall 11 can be protected from the ink. In other words, ink resistance of the pressure chamber 12 can be improved.

Note that the first amorphous film 15 and a second amorphous film 55 are, desirably, amorphous films formed of an oxide or a nitride containing any one of metals hafnium (Hf), tantalum (Ta), niobium (Nb), zirconium (Zr), and aluminum (Al), or an oxide or a nitride containing some of the above metals. The first amorphous film 15 and the second amorphous film 55 can be formed, for example, by a MOD method, a sol-gel method, a sputtering method, a CVD method, and the like.

By forming the first amorphous film 15 from the above materials, occurrence of cracking in the diaphragm 50 can be suppressed in a more reliable manner, and since the above materials are low soluble compounds, ink resistance can be improved even further.

Furthermore, the elastic film 51 of the diaphragm 50 is formed of amorphous silicon oxide. The first amorphous film 15 described above is provided on a surface of the elastic film 51 on the pressure chamber 12 side. In other words, the first amorphous film 15 overlaps the elastic film 51 formed of amorphous silicon oxide. With the above configuration, occurrence of cracking in the diaphragm 50 can be suppressed in a further reliable manner and the ink resistance can be improved even further.

Furthermore, the active portion 310 is not provided in the center portion A of the diaphragm 50. The second amorphous film 55 is formed in the center portion A. By providing the second amorphous film 55 in the center portion A of the diaphragm 50, the stiffness of the diaphragm 50 is improved and occurrence of cracking can be suppressed. Furthermore, since the second amorphous film 55 is amorphous, the displacement of the diaphragm 50 is less likely to be impeded compared with a configuration in which a crystalline film is provided in the center portion A of the diaphragm 50. Accordingly, by providing the second amorphous film 55 in the center portion A of the diaphragm 50, occurrence of cracking in the diaphragm 50 can be suppressed and a decrease in the amount of displacement of the diaphragm 50 can be suppressed.

Furthermore, the second amorphous film 55 can be formed of a material that is the same as that of the first amorphous film 15. By forming the second amorphous film 55 from such a material, occurrence of cracking in the diaphragm 50 can be suppressed in a further reliable manner and the decrease in the amount of displacement of the diaphragm 50 can be suppressed even further.

Note that while the first amorphous film 15 and the second amorphous film 55 are each single layered, not limited to being single layered, the first amorphous film 15 and the second amorphous film 55 may be configured of a plurality of layers.

Fourth Exemplary Embodiment

Figure 9:
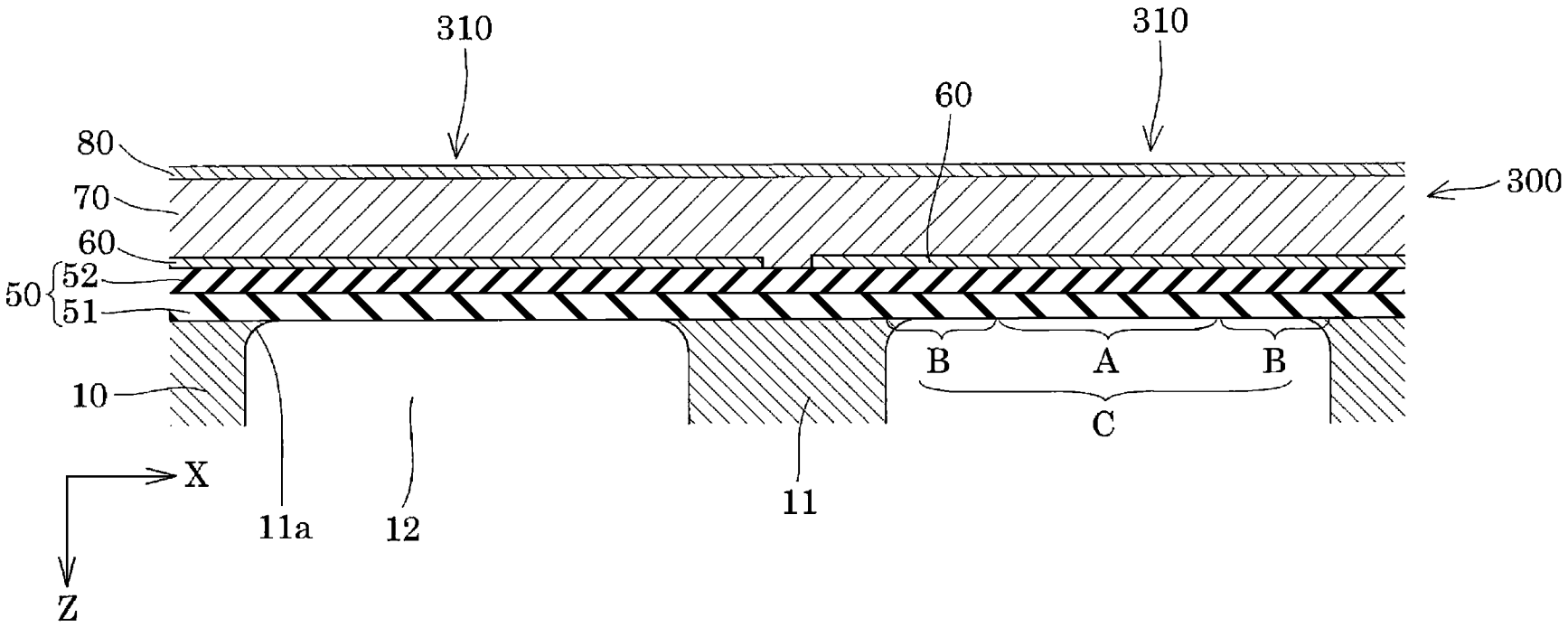
FIG. 9 is a cross-sectional view of an essential portion of piezoelectric actuators according to a fourth exemplary embodiment.

Referring to FIG. 9, a recording head according to a fourth exemplary embodiment will be described. FIG. 9 is a cross-sectional view of the recording head cut along a plane that is parallel to the XZ plane that passes through the piezoelectric actuator 300 and the pressure chamber 12. Note that components that are the same as those of the first exemplary embodiment are denoted with the same reference numerals and repeated descriptions thereof are omitted.

Referring still to FIG. 9, a plurality of pressure chambers 12 are formed in the flow path forming substrate 10. Each active portion 310 formed on the diaphragm 50 is provided between the pressure chambers 12, in other words, is provided to above the partition wall 11. Since the active portion 310 is provided so as to extend to between the pressure chambers 12 in the above manner, the amount of displacement of the diaphragm 50 can be increased, and the amount of ink ejected can be increased.

Furthermore, the active portion 310 is formed in the moveable area C of the diaphragm 50 and is, in at least one direction that intersects the Z direction that is the layered direction, or in the X direction herein, provided so as to extend to both sides of the pressure chamber 12 while having the pressure chamber 12 in between. In other words, while not illustrated in the drawing in particular, when in plan view in which the piezoelectric actuator 300 is viewed in the Z direction, the active portion 310 is provided, in the X direction, from the partition wall 11 on one side of the pressure chamber 12 to the partition wall 11 on the other side of the pressure chamber 12 while passing through the pressure chamber 12. It goes without saying that the active portion 310 may be provided to extend also in the Y direction in a similar manner. Since the active portion 310 is provided so as to extend to both sides of the pressure chamber 12 in the above manner, the amount of displacement of the diaphragm 50 can be increased, and the amount of ink ejected can be increased.

Other Exemplary Embodiment

While exemplary embodiments of the present disclosure has been described above, the basic configurations of the present disclosure are not limited to those described above.

While in the first exemplary embodiment, the active portion 310 overlaps at least a portion of the pressure chamber 12 in plan view, the present disclosure is not limited to such a configuration. For example, when in plan view, the active portion 310 may overlap the entire surface of the pressure chamber 12.

Furthermore, while the pressure chamber 12 is formed so that, the closer to the piezoelectric actuator 300 in the Z direction, the widths in the X direction and the Y direction that intersect the Z direction, which is the layered direction, become smaller, the present disclosure is not limited to such a configuration. For example, the pressure chamber 12 may be formed so that, the closer to the piezoelectric actuator 300 in the Z direction, a width of the pressure chamber 12 in any direction that intersects the Z direction becomes smaller.

Figure 10:
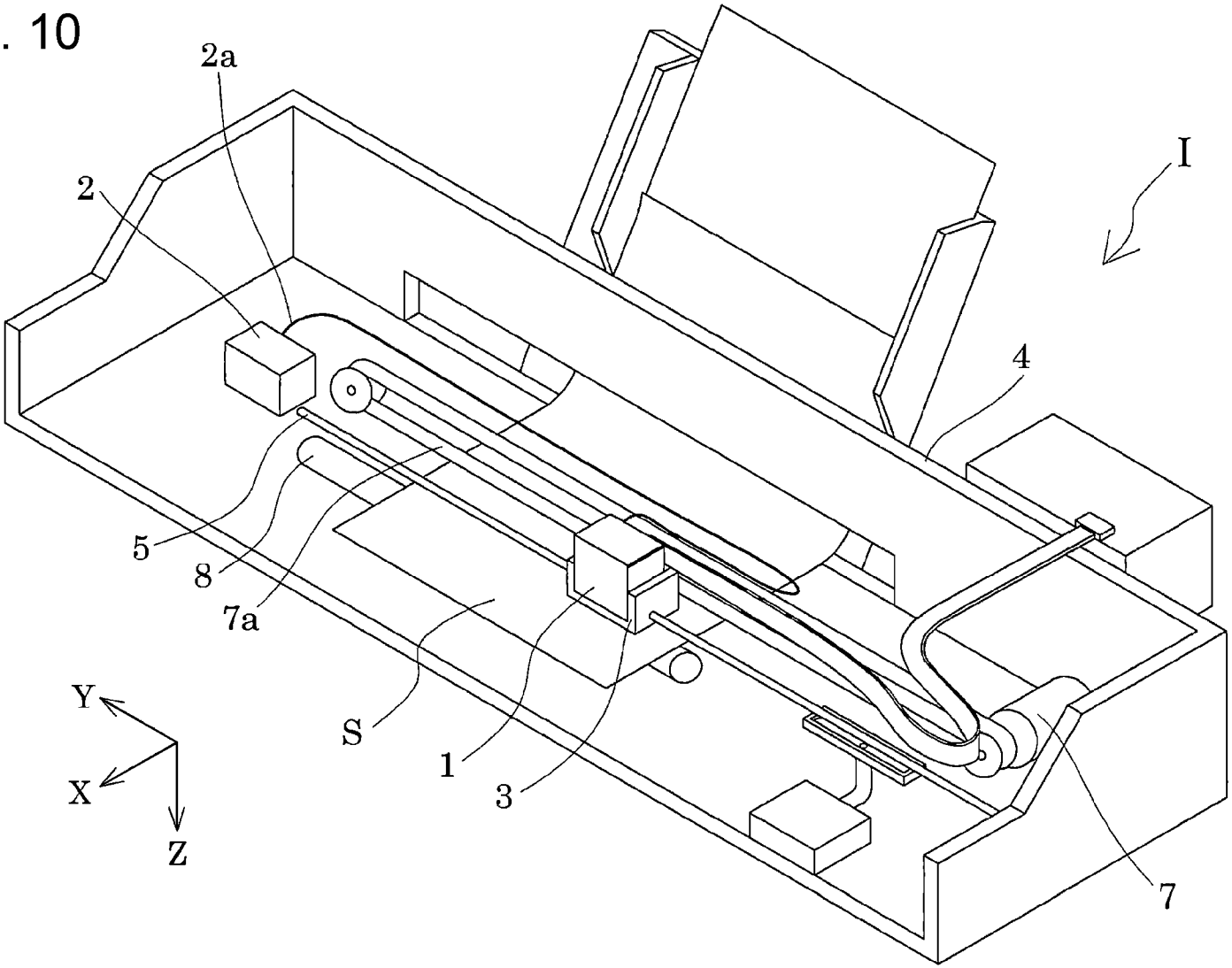
FIG. 10 is a diagram illustrating a schematic configuration of a recording apparatus according to an exemplary embodiment.

Referring now to FIG. 10, an example of an ink jet recording apparatus that is an example of a liquid ejecting apparatus of the present exemplary embodiment will be described. Note that FIG. 10 is a diagram illustrating a schematic configuration of the ink jet recording apparatus of the present disclosure.

In an ink jet recording apparatus I that is an example of the liquid ejecting apparatus, a plurality of recording heads 1 is mounted on a carriage 3. The carriage 3 on which the recording heads 1 are mounted is provided on a carriage shaft 5 attached to an apparatus body 4 so as to be moveable in an axial direction. In the present exemplary embodiment, the direction in which the carriage 3 moves is a first axial direction, which is the Y direction.

Furthermore, a tank 2 that is a storage member in which ink, serving as a liquid, is stored is provided in the apparatus body 4. The tank 2 is coupled to the recording heads 1 through supply pipes 2*a*, such as tubes and the like. The ink from the tank 2 is supplied to the recording heads 1 thorough the supply pipes 2*a*. Note that the apparatus may be configured with a plurality of tanks 2.

Furthermore, the carriage 3 on which the recording heads 1 are mounted is moved along the carriage shaft 5 by having driving force of a drive motor 7 be transmitted to the carriage 3 through a plurality of gears and a timing belt 7*a*. A transport roller 8 serving as a transport member is provided in the apparatus body 4. A recording sheet S, which is a medium such as paper on which ejection is performed, is transported with the transport roller 8. Note that the transport member that transports the recording sheet S is not limited to the transport roller 8 and may be a belt, a drum, or the like. In the present exemplary embodiment, the transport direction of the recording sheet S is the X direction.

Note that in the ink jet recording apparatus I described above, an example has been described in which the recording heads 1 mounted in the carriage 3 move in the main scanning direction; however, not limited to the above configuration in particular, for example, a so-called line recording apparatus in which the recording heads 1 are fixed and in which printing is performed by just moving the recording sheet S such as paper and the like in the sub scanning direction may be applied to the present disclosure.

Furthermore, in the exemplary embodiments, the ink jet recording head has been described as an example of the liquid ejecting head, and the ink jet recording apparatus has been described as an example of the liquid ejecting apparatus; however, the present disclosure is subject widely to liquid ejecting heads and liquid ejecting apparatuses in general. It goes without saying that the present disclosure can be applied to liquid ejecting heads and liquid ejecting apparatuses that eject a liquid other than ink. Other liquid ejecting heads include, for example, various recording heads used in image recording apparatuses such as a printer, a coloring material ejecting head used in manufacturing a color filter of a liquid crystal display and the like, an electrode material ejecting head used to form electrodes of an organic EL display, a field emission display (FED), and the like, and a bio organic matter ejecting head used to manufacture biochips. The present disclosure can also be applied to liquid ejecting apparatuses that include the above liquid ejecting heads.

What is claimed is:

1. A liquid ejecting head comprising:

a flow path forming substrate in which a pressure chamber in communication with a nozzle is formed;

a diaphragm formed on one side of the flow path forming substrate; and a piezoelectric actuator including a first electrode, a piezoelectric layer, and a second electrode that are formed on the diaphragm on a side opposite the flow path forming substrate, wherein the piezoelectric actuator includes an active portion defined by an area of the piezoelectric layer that is overlapped by and between the first electrode and the second electrode, in plan view, the active portion overlaps an entire perimeter of the pressure chamber and is extended to an outside of the pressure chamber about the entire perimeter of the pressure chamber, and the pressure chamber is formed so that, the closer to the piezoelectric actuator in a layered direction of the flow path forming substrate and the diaphragm, a width of the pressure chamber in a direction intersecting the layered direction becomes smaller.

2. The liquid ejecting head according to claim 1, wherein the pressure chamber is defined by a partition wall formed in the flow path forming substrate, and the diaphragm, and a curved surface is formed in a boundary in the pressure chamber between the diaphragm and the partition wall.

3. The liquid ejecting head according to claim 2, wherein a radius of curvature of the curved surface ranges from 10 nm to 1000 nm inclusive.

4. The liquid ejecting head according to claim 2, wherein at least a portion of the curved surface is, in the layered direction, provided on a piezoelectric actuator side of the partition wall.

5. The liquid ejecting head according to claim 1, wherein an amorphous film is formed on an inner surface of the pressure chamber, and the amorphous film is formed on a surface of the diaphragm on a pressure chamber side.

6. The liquid ejecting head according to claim 5, wherein the amorphous film is an oxide or a nitride that contains any one of metals Hf, Ta, Nb, Zr, and Al, or is an oxide or a nitride that contains some of the metals.

7. The liquid ejecting head according to claim 5, wherein the diaphragm contains amorphous silicon oxide.

8. The liquid ejecting head according to claim 1, wherein in a center portion of an area in the diaphragm that opposes the pressure chamber in plan view, the active portion is not provided and an amorphous film is formed.

9. The liquid ejecting head according to claim 8, wherein the amorphous film is an oxide or a nitride that contains any one of metals Hf, Ta, Nb, Zr, and Al, or is an oxide or a nitride that contains some of the metals.

10. The liquid ejecting head according to claim 1, wherein a plurality of pressure chambers are formed in the flow path forming substrate, and the active portion is provided so as to extend to between the plurality of pressure chambers.

11. The liquid ejecting head according to claim 1, wherein in an area of the active portion in plan view, the pressure chamber is formed so that, the closer to the piezoelectric actuator in the layered direction of the flow path forming substrate and the diaphragm, a width of the pressure chamber in the direction intersecting the layered direction becomes smaller.

12. A liquid ejecting apparatus comprising: the liquid ejecting head according to claim 1.

* * * * *